US008889974B2

(12) United States Patent
Hayes

(10) Patent No.: US 8,889,974 B2
(45) Date of Patent: Nov. 18, 2014

(54) ADJUSTABLE CHIN SUPPORT FOR MUSICAL INSTRUMENT

(71) Applicant: Kreddle Rest LLC, Great Falls, MT (US)

(72) Inventor: Jordan Hayes, Great Falls, MT (US)

(73) Assignee: Kreddle Rest LLC, Great Falls, MT (US)

( * ) Notice: Subject to any disclaimer, the term of this patent is extended or adjusted under 35 U.S.C. 154(b) by 0 days.

(21) Appl. No.: 13/738,967

(22) Filed: Jan. 10, 2013

(65) Prior Publication Data

US 2014/0190329 A1 Jul. 10, 2014

(51) Int. Cl.
*G10D 1/02* (2006.01)
*G10D 3/18* (2006.01)

(52) U.S. Cl.
CPC ..... *G10D 3/18* (2013.01)
USPC ..... 84/279; 84/280

(58) Field of Classification Search
CPC ..... G10D 3/18
USPC ..... 84/279, 280
See application file for complete search history.

(56) References Cited

U.S. PATENT DOCUMENTS

| | | | | | |
|---|---|---|---|---|---|
| 932,844 | A | * | 8/1909 | Beisheim | 84/280 |
| 1,204,642 | A | | 11/1916 | Beck | |
| 1,225,566 | A | | 5/1917 | Boles | |
| 2,061,464 | A | * | 11/1936 | Heimers | 84/280 |
| 2,208,824 | A | * | 7/1940 | Weinberg | 84/280 |
| 2,486,646 | A | | 11/1949 | Halko | |
| 3,683,098 | A | * | 8/1972 | Chavez, Jr. | 84/278 |
| 4,212,222 | A | * | 7/1980 | Henkle | 84/278 |
| 4,333,378 | A | * | 6/1982 | Hrdlicka | 84/280 |
| 4,534,259 | A | | 8/1985 | Wolf | |
| 5,208,409 | A | * | 5/1993 | Roulet | 84/278 |
| 6,369,303 | B1 | * | 4/2002 | Hvezda | 84/278 |
| 6,667,430 | B1 | * | 12/2003 | Liao | 84/279 |
| 7,368,645 | B2 | * | 5/2008 | Armstrong et al. | 84/278 |
| 7,576,274 | B1 | | 8/2009 | Frisch et al. | |
| 2013/0276611 | A1 | * | 10/2013 | Vochezer | 84/280 |
| 2014/0190329 | A1 | * | 7/2014 | Hayes | 84/279 |

* cited by examiner

*Primary Examiner* — Robert W Horn
(74) *Attorney, Agent, or Firm* — Neugeboren O'Dowd PC

(57) ABSTRACT

Instrument chin support, and method providing a means for adjusting placement along any and all 3-dimensional axes (x, y, z). An assembled chin support can include a chin-plate shaped to provide the player with comfort; a ball joint and clamp that allow the adjustment of any or all angles in the x, y and z axes (i.e. rotation, yaw, pitch, tilt, and roll); an eccentric post that mates with a base-clamp so as to provide the player with a means to customize the height and lateral position (i.e. y and z axes) of the chin-plate; and a bracket commonly known in the art to affix the chin support to the instrument. Advantages include providing players with a chin support that players can customize to their individual body. By doing so this chin support can help alleviate most of the adverse health concerns many players struggle with while playing their instrument.

8 Claims, 9 Drawing Sheets

ADJUSTABLE CHIN SUPPORT FOR MUSICAL INSTRUMENT

CROSS-REFERENCE TO RELATED APPLICATIONS

This application claims the benefit of provisional patent application Ser. No. 61/584,934, filed 2012 Jan. 10 by the present inventor.

FEDERALLY SPONSORED RESEARCH

Not Applicable

SEQUENCE LISTING OR PROGRAM

Not Applicable

BACKGROUND

1. Field

The present invention generally relates to a chin support device for a musical instrument, and specifically, to a chin support for a user of violin and viola.

2. Prior Art

Violinists and violists began using devices that can be called chin supports at the beginning of the eighteenth century. The first chin supports were hardly more than blocks of wood. Over time craftsman began making chin supports that were increasingly more sophisticated and that began to take on the curved shape of most chin supports today. The current general chin support design has been in use at the latest since the late nineteenth century, and has remained essentially unchanged since. The most commonly used chin support of today is not capable of any customization as determined by the player. The large variety of neck lengths, chin shapes, and playing styles of violinists and violists far surpasses the efficacy of the "one-size-fits-all" chin supports of today to satisfactorily address each players needs.

Current violin and viola technique dictates that the player positions the violin or viola (hereafter: "instrument") on the left side of the body between the chin or jaw and the collarbone. Chin supports are commonly used by violinists and violists (hereafter: "players") to help hold the instrument and increase comfort while playing. Chin supports should accomplish this task in one primary way: ideally the chin support fills in the gap between the top of the instrument (as it rests upon the collarbone in playing position) and the chin. By filling in this gap, chin supports provide the player with a means to stabilize the instrument while in playing position. Other aspects of chin support-to-jaw fit add or subtract to the players sense of security. If the chin support follows the contour of the players jaw, allows the player to angle the violin towards the body how they wish, and allows the player to choose how to position the angle of their head according to their needs, then the chin support is performing its function well. In reality very few players would answer positively to all of these criteria for their current chin support. In most cases, players learn to deal with the adverse effects that can result from the absence of any or all of these ideal functions the chin support should perform. Currently available chin support designs fall seriously short of accommodating all players. Only players who have necks of short to moderate length can find chin supports that will adequately fill in the gap between the top of the instrument and their jaw, and none allow the player further useable customization.

Rudimentary devices are known in the art to address making some adjustment in chin supports for instruments. For example, U.S. Pat. No. 1,204,642 to Becker describes a raiseable and tiltable chin support, but the lateral position, rotational angle, and yaw angle cannot be changed. U.S. Pat. No. 4,534,259 to Wolf describes a chin support that can "pivot" with the movements of the players head, and that can conform to the shape of the players chin, but the height, yaw angle, tilt, and lateral position cannot be adjusted. Also, U.S. Pat. No. 1,225,566 to Boles and U.S. Pat. No. 2,486,646 to Haiko both show the ability to raise the chin support, and Haiko's shows the ability to adjust lateral position, but neither offers the ability to adjust tilt, rotation, and yaw angle. Lastly, U.S. Pat. No. 7,576,274 B1 to Frisch shows the ability to customize fit-to-chin as well as height, tilt, and yaw angle, but lateral position and rotation cannot be practically addressed. Additionally, the Frisch model does not allow further adjustment once the initial adjustment is accomplished, limiting the player in the future to the initial set-up.

Thus several advantages of the various embodiments of my chin support are to provide players with a chin support that provides adjustment along one or more of the three axes (i.e. x, y, z). Other advantages of one or more aspects are to provide players with a chin support that players can customize to their individual body type. By doing so this chin support can help alleviate most of the adverse health concerns many players struggle with while playing their instrument. These and other advantages of one or more aspects will become apparent from a consideration of the ensuing description and accompanying drawings.

SUMMARY

In accordance with one embodiment a chin support comprises a chin-plate shaped to provide the player with comfort; a ball joint and clamp that allow the adjustment of any or all angles in the x, y and z axes (i.e. rotation, yaw, pitch, tilt, and roll); an eccentric post that mates with a base-clamp so as to provide the player with a means to customize the height and lateral position (i.e. y and z axes) of the chin-plate; and a bracket commonly known in the art to affix the chin support to the instrument.

DRAWINGS

Figure 1A:
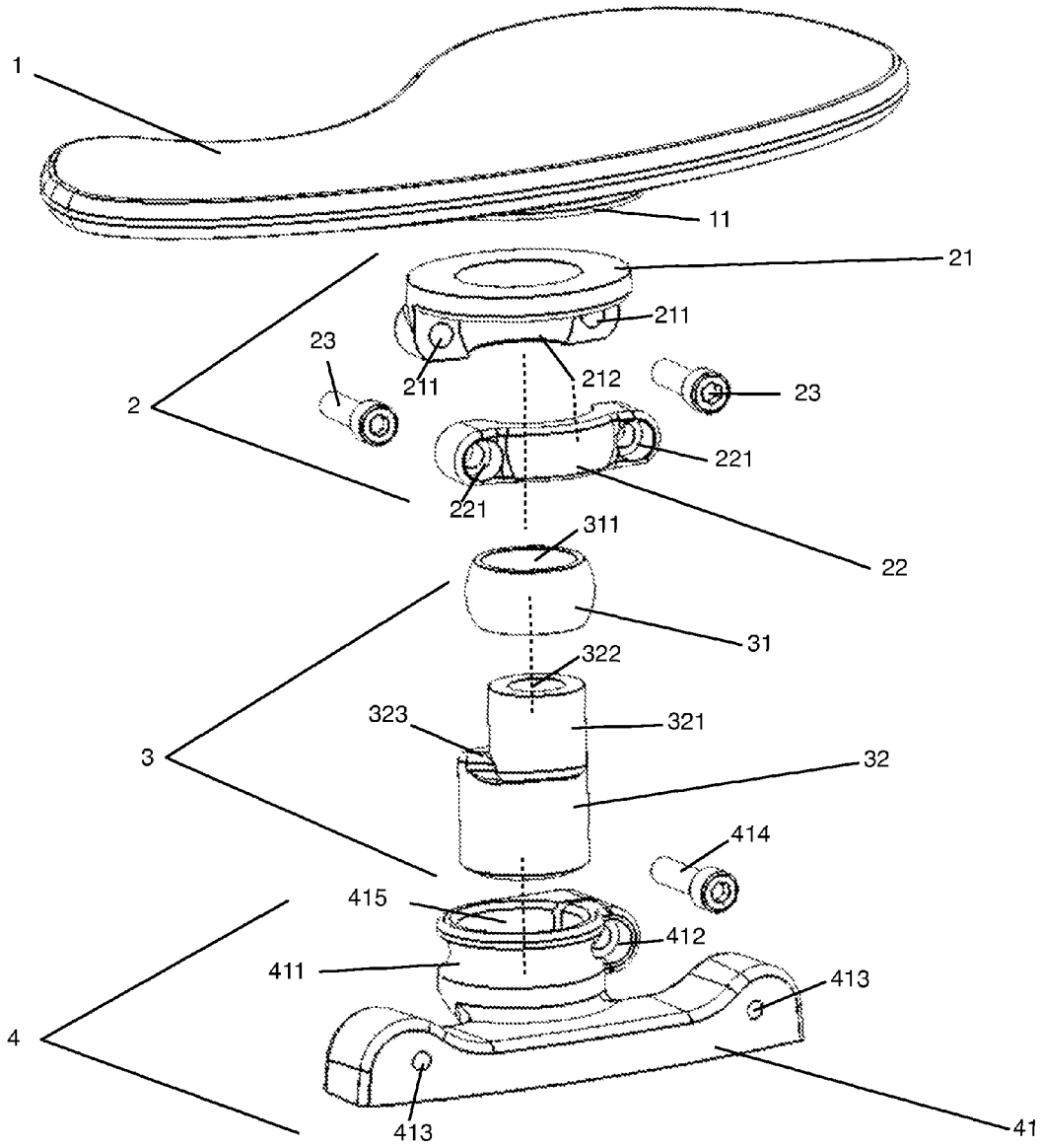
FIG. 1A—Exploded view of one embodiment.
Figure 1B:
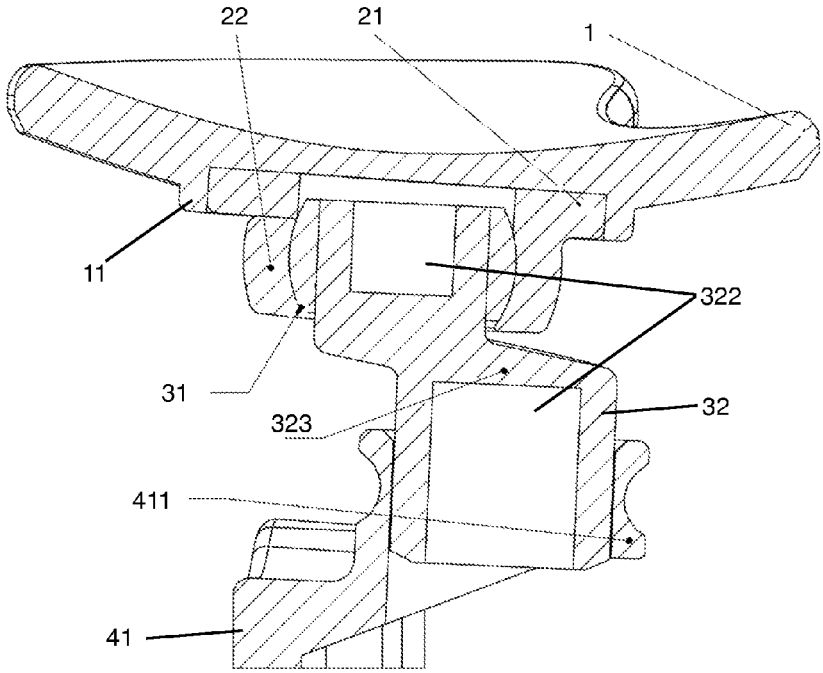
FIG. 1B—Cross-sectional view of one embodiment.
Figure 1C:
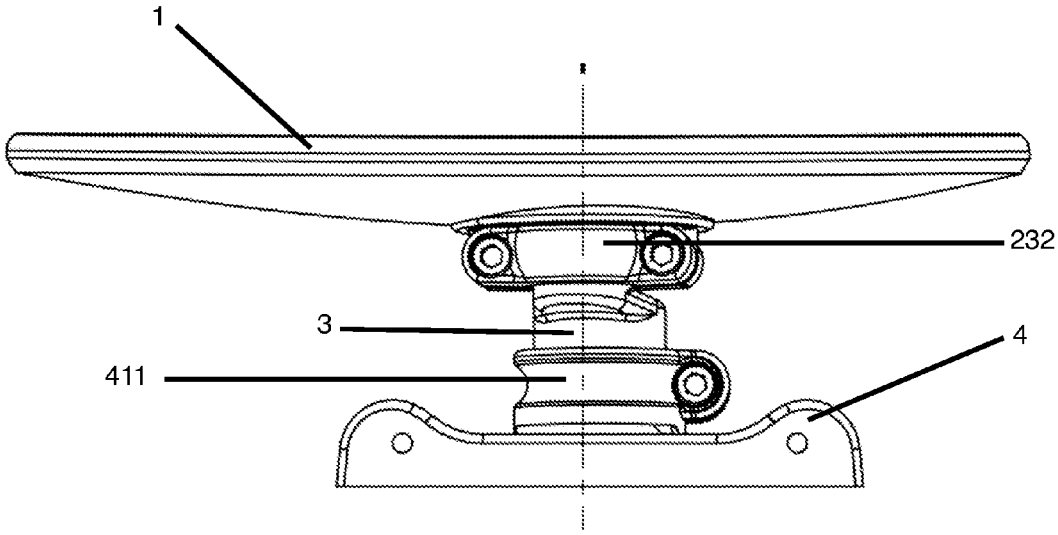
FIG. 1C—Assembled front view of one embodiment.
Figure 1D:
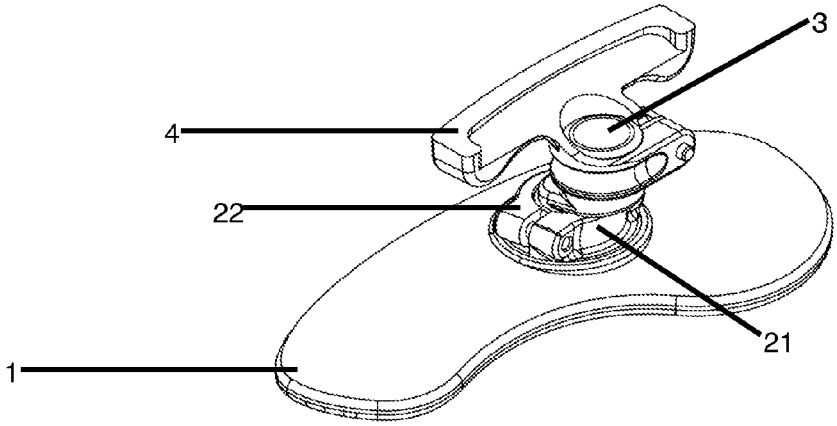
FIG. 1D—Isometric view of underside of one embodiment.

| DRAWINGS - Reference Numerals | |
|---|---|
| 1 | chin-plate |
| 1a | alternate chin-plate |
| 11 | socket |
| 11a | ball-socket |
| 111a | male-threaded outer surface |
| 112a | inner ball-socket |
| 12a | clamping ring |
| 121a | female-threaded inner surface |
| 122a | ball-socket |
| 13 | chin-plate extension |
| 2 | ball-clamp |
| 21 | rear ball-clamp |
| 211 | threaded screw-socket |
| 212 | ball-socket |
| 22 | front ball-clamp |
| 221 | screw-socket |
| 23 | screw |
| 3 | ball-post |
| 31 | ball |
| 311 | threaded inner hollow |
| 32 | post |
| 32a | alternate post |
| 321 | threaded outer surface |
| 322 | hollow inner core |
| 323 | eccentric offset |
| 4 | base-clamp |
| 4a | collet-base |
| 41 | base |
| 41a | collet-ring |
| 411 | clamp |
| 411a | female-threaded inner surface |
| 412 | screw-socket |
| 413 | female-threaded bracket socket |
| 42a | collet flanges |
| 421a | inner hollow |
| 422a | male-threaded outer surface |
| 414 | screw |
| 415 | inner hollow of base-clamp |
| 416 | pad |
| 5 | bracket-assembly |
| 51 | angled bracket screws |
| 52 | threaded tensioning sleeve |
| 53 | threaded angle bracket |
| 531 | pad |
| 7 | instrument |
| 71 | end pin |
| 72 | tail gut |
| 73 | tail piece |
| 8 | pad |

DETAILED DESCRIPTION

FIGS. 1A, 1B, 1C, 1D, 2A, 2B, 2C, 2D, 5A, 5B

First Embodiment

Figure 5A:
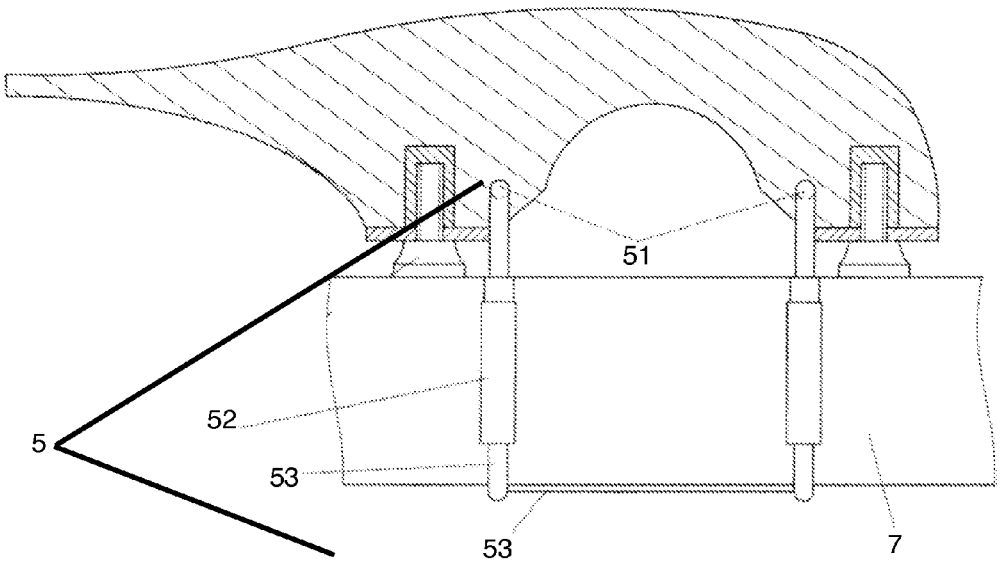
FIG. 5A (Prior Art)
FIG. 5A—Front view of bracket commonly known in the prior art.

One embodiment of the chin support is illustrated in FIGS. 1A and 5A. The chin support is comprised of a chin-plate 1, a ball-clamp 2, a ball-post 3, a base-clamp 4, and a bracket-assembly 5.

The chin-plate 1 has an arcuate edge and concave top surface to provide the player with a comfortable surface upon which to place their jaw. The underside surface of the chin-plate 1 can be concave, convex, or flat. The underside of the chin-plate 1 has a socket 11 into which the ball-clamp 2 is affixed via epoxy, glue, screws, or another type of affixing method. The ball-clamp 2 has a ball-socket 212 into which the ball-post 3 is set and clamped. Thus the chin-plate 1 and ball-clamp 2 constitute a means for coupling with a ball-post 3. The ball-post 3 is then inserted into the inner hollow of the base-clamp 415. Thus the base-clamp 4 constitutes a means for coupling with a ball-post 3. The base-clamp 4 is then attached to the instrument 7 by the bracket-assembly 5 using methods commonly known in the art. Thus the base-clamp 4 and the bracket-assembly 5 constitute a means for affixing the chin support to the instrument 7.

Figure 2A:
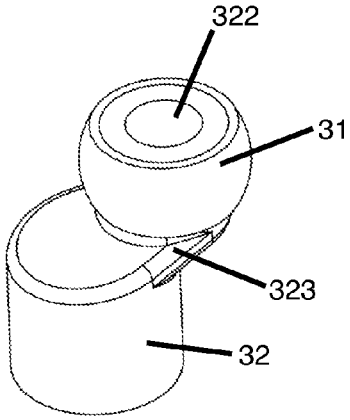
FIG. 2A—Isometric view of eccentric ball-post.
Figure 2B:
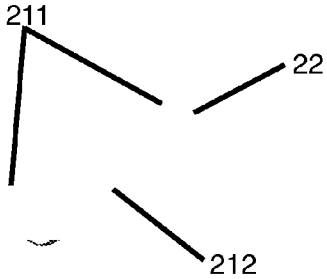
FIG. 2B—Isometric view of front ball-clamp.
Figure 2C:
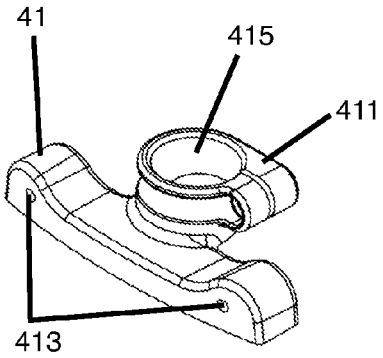
FIG. 2C—Isometric view of base-clamp.
Figure 2D:
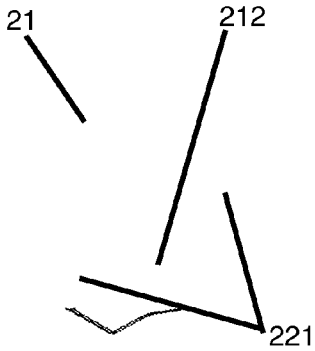
FIG. 2D—Isometric view of rear ball-clamp.
Figure 3A:
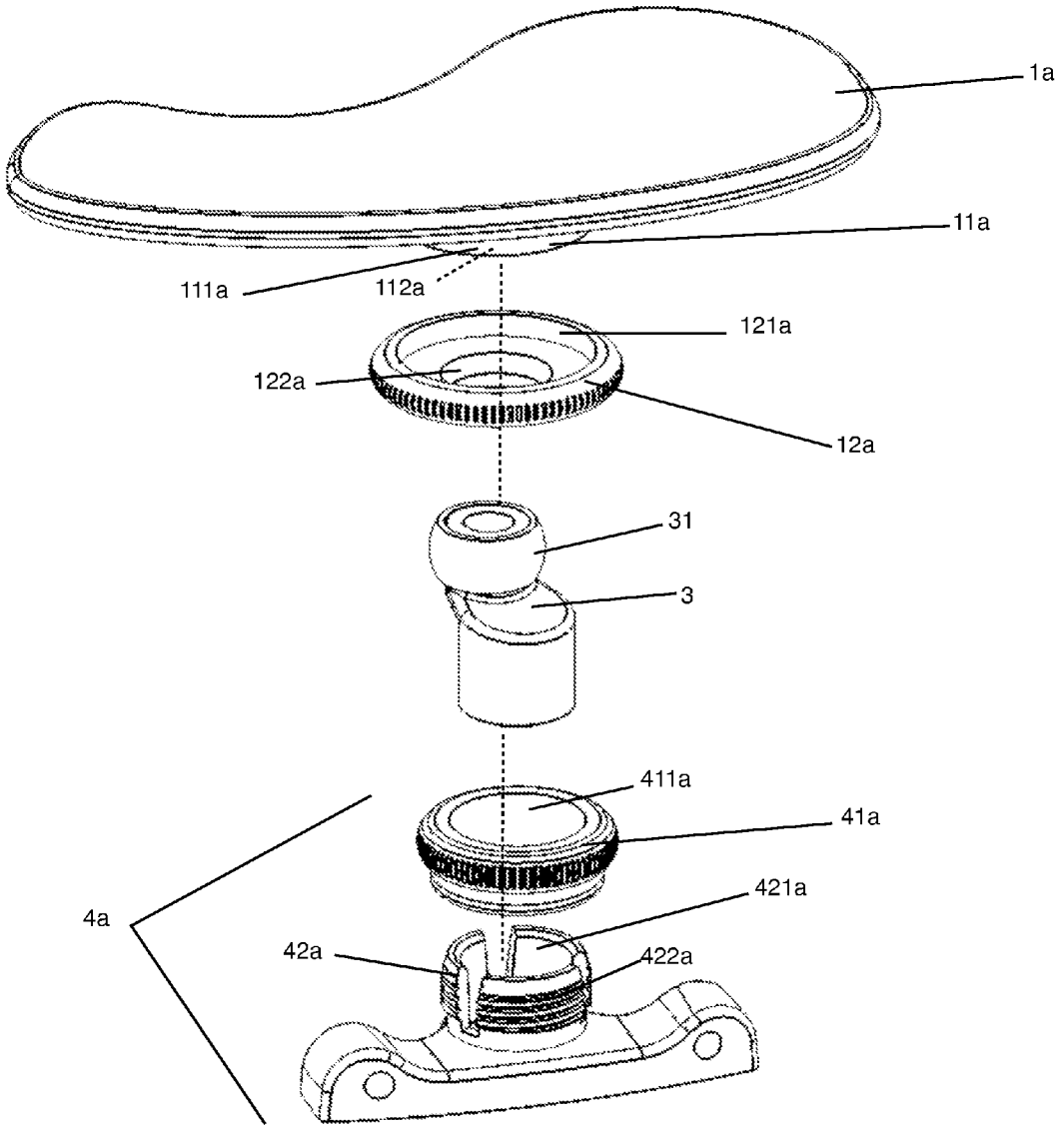
FIG. 3A—Exploded view of alternate embodiment.
Figure 3B:
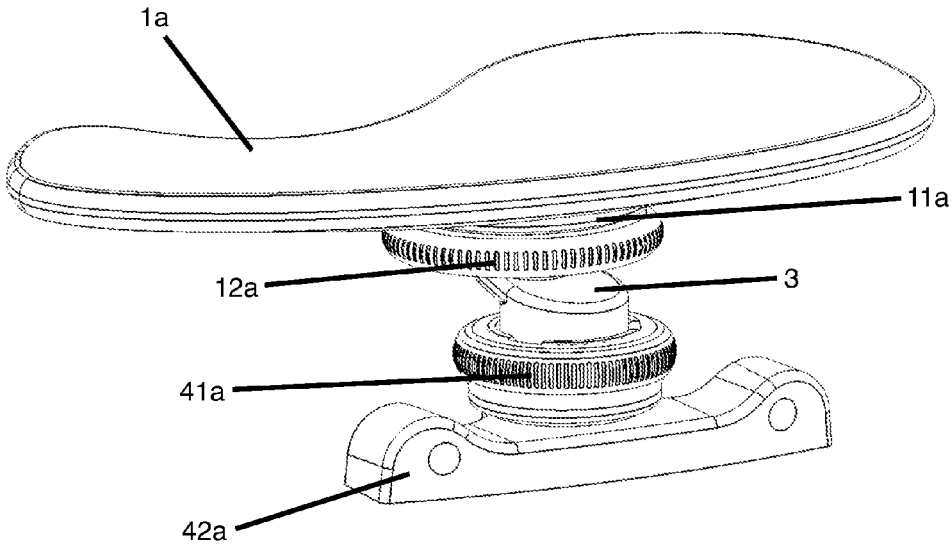
FIG. 3B—Assembled isometric view of alternate embodiment.
Figure 3C:
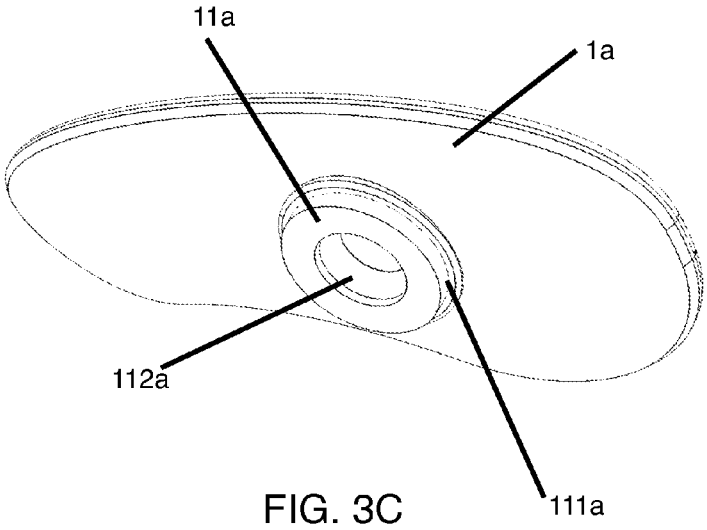
FIG. 3C—Isometric view of underside of alternate embodiment chin-plate.

The ball-clamp 2 (FIGS. 1A, 2B, and 2D) can be comprised of a rear ball clamp 21, a front ball-clamp 22, and one or more screws 23. The rear ball-clamp 21 and front ball-clamp 22 have a ball-socket 212. The inner wall of the ball-socket 212 approximates the curvature of the ball 31. The rear ball-clamp 21 has two threaded screw-sockets 211. The front ball-clamp 22 has two screw-sockets 221. The rear ball-clamp 21 and the front ball-clamp 22 are joined by passing two screws 23 through the screw-sockets 221 and then screwing the screws 23 into the two threaded screw-sockets 211.

The ball-post 3 (FIGS. 1A, and 2A) can be comprised of a ball 31, and a post 32. The ball 31 can have a threaded inner hollow 311. The ball 31 can have a convex outer surface. The top and bottom of the ball 31 can be cut off as shown. The upper portion of the post 32 can have a threaded outer surface 321. The post 32 can also have an eccentric offset 323, and can have hollow inner core 322. The ball 31 and post 32 can be joined by mating the threaded outer surface 321 of the post 32 with the threaded inner hollow 311 of the ball 31.

Figure 5B:
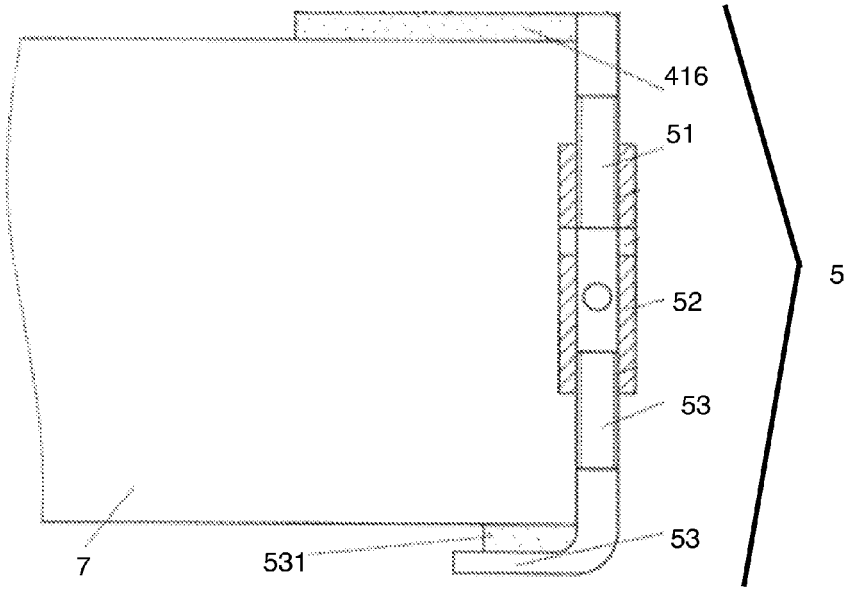
FIG. 5B (Prior Art)
FIG. 5B—Side view of bracket commonly known in the prior art.
Figure 5C:
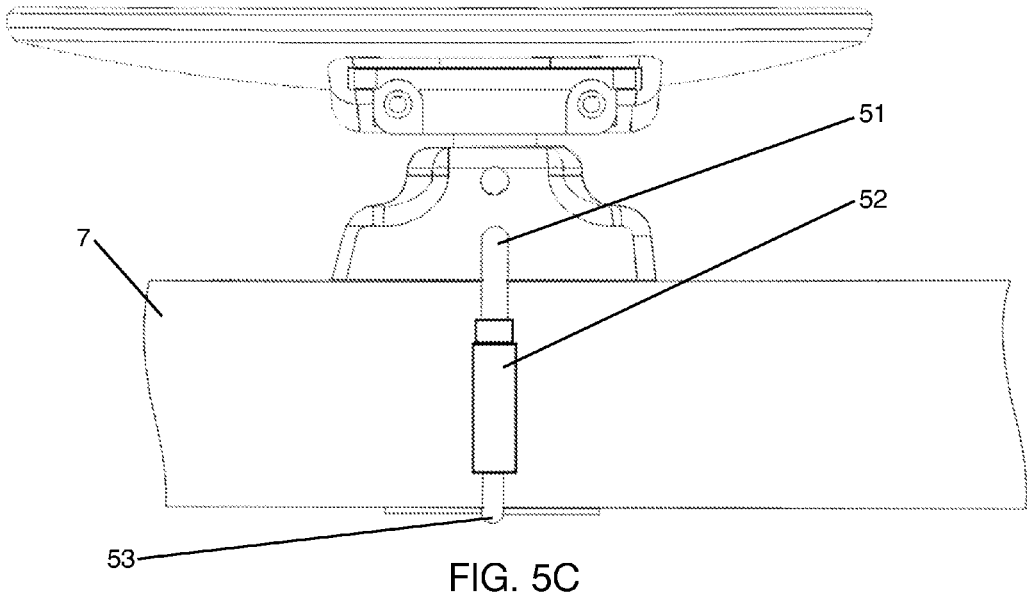
FIG. 5C—Front view of alternate embodiment of bracket.
Figure 5D:
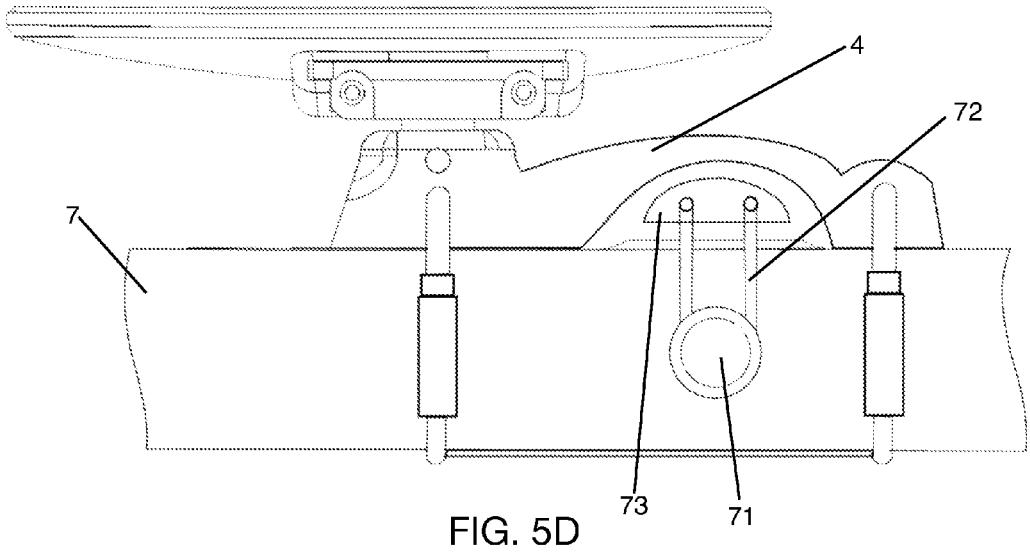
FIG. 5D—Front view of alternate embodiment of base-clamp and bracket.
Figure 5E:
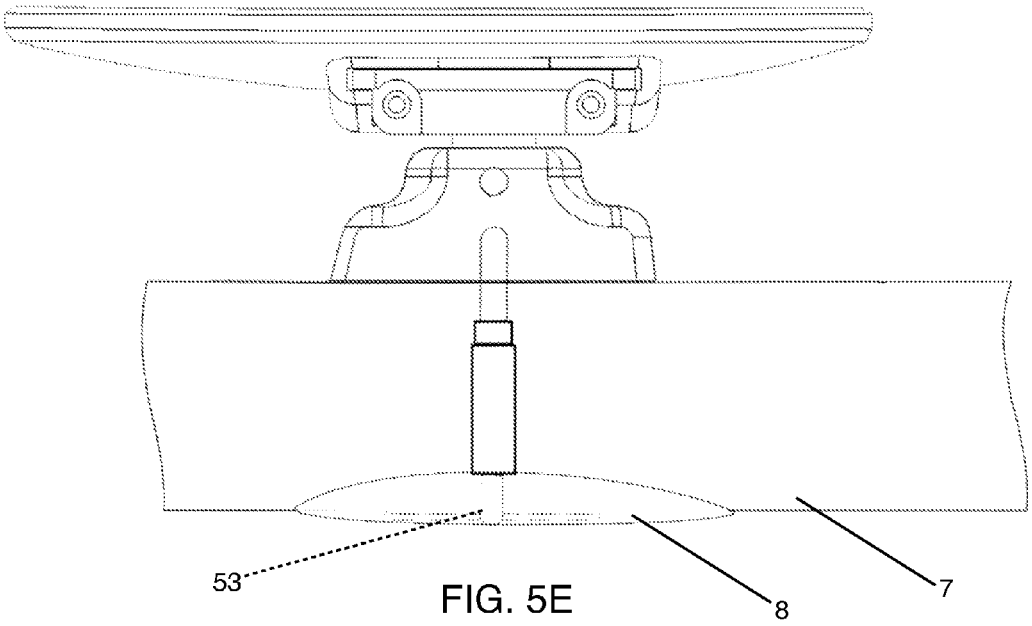
FIG. 5E—Front view of one embodiment of pad.

The base-clamp 4 (FIGS. 1A, 2C, and 5B) can be comprised of a base 41, a clamp 411, a screw-socket 412, and two female-threaded bracket sockets 413. To operate the clamp 411, a screw 414 is mated with the female threads of the screw-socket 412. To protect the surface of the instrument 7 a pad 416 is affixed with glue or other affixing method to the bottom surface of the base 41. The base-clamp 4 can be joined to the bracket-assembly 5 by mating the male threads of the two angled bracket screws 51 with the two female-threaded bracket sockets 413.

The bracket-assembly 5 (FIGS. 5A and 5B) can be comprised of one or more male threaded angled bracket screws 51, one or more female threaded tensioning sleeves 52, a male threaded angle bracket 53, and a pad 531. The bracket-assembly 5 is assembled by mating the male threaded angle bracket screws 51 with the female threaded tensioning sleeves 52, and then mating the female threaded tensioning sleeves 52, with the male threaded angle bracket 53. To protect the surface of the instrument 7 a pad 531 is affixed to the threaded angle bracket 53 using glue or other affixing method. The bracket-assembly 5 is affixed to the instrument by tightening the threaded tensioning sleeves 52 as is commonly known in the art.

Operation—FIGS. 1A, 1B, 1C, 1D, 2A, 2B, 2C, 2D, 5A, 5B The chin support (FIG. 1A) is assembled by affixing the ball-clamp 2 to the chin-plate 1. Then the ball-post 3 is assembled by mating the threaded inner hollow of the ball 311 with the threaded outer surface of the post 321. Then the ball 31 of the ball-post 3 is laid into the ball-socket 212 of the rear ball-clamp 21. Then the ball-socket 212 of the front ball-clamp 22 is laid onto the ball 31 of the ball-post 3. Then the screws 23 are passed through the screw sockets 221 and mated with the threaded screw sockets 211. Once the screws 23 are tightened down, the ball-post 3 will be effectively clamped between the rear and front ball-clamps 21, and 22. Then the post 32 of the ball-post 3 is inserted into the inner hollow of the base-clamp 415. The ball-post 3 is then clamped into the clamp 411 by mating the screw 414 with the screw socket 412 and tightening the screw 414. The base-clamp 4 is then joined with the bracket 5 by mating the two male-threaded angle bracket screws 51 with the female-threaded bracket sockets 413. The bracket-assembly 5 is then assembled by the method commonly known in the art and as previously described.

To operate the ball-clamp 2, the screws 23 are loosened which then allows the ball-clamp 2 to move around the ball 31. By moving the ball-clamp 2 around the ball 31 the player is able to customize the angles of rotation, yaw, pitch, and tilt (i.e. any angles along the x, y, and z axes) of the assembled chin-plate and ball-clamp 1, and 2. Once the player has found the correct placement for the chin-plate 1 according to their needs, the screws 23 are tightened down to prevent any movement of the chin-plate and ball-clamp 1, and 2.

To operate the base-clamp 4, the screw 414 is loosened to allow the ball-post 3 to rotate and move up and down within the clamp 411. By rotating the ball-post 3 in the clamp 411, the player can customize the lateral placement (i.e. placement along the z-axis) of the chin-plate 1. This is accomplished because when the ball-post 3 is rotated within the clamp 411, the eccentric offset 323 in the post 32 causes the ball 31, ball-clamp 2, and chin-plate 1, to move in a lateral circle. By moving the ball-post 3 up and down within the clamp 411, the player can customize the resulting height of the chin-plate 1 as it relates to the instrument 7. Once the proper height and lateral placement is found, the screw 414 is then tightened to prevent any further movement of the chin-plate 1, ball-clamp 2, and ball-post 3.

Materials

A number of materials can be used to make the above and alternate embodiments. It is common in the art to make the chin-plate 1 out of a hardwood such as ebony, rosewood, boxwood, maple, walnut, pine or other woods. The embodiment presented above or any alternate embodiments can be made out of any of these or other woods. The chin-plate 1 can also be made out of ceramics, plastics, plastic composites, fiber-glasses, epoxies, aluminum, titanium, magnesium, carbon-fiber blends, or other suitable materials. The ball-clamp 2, ball-post 3, and base-clamp 4, can all be made with various combinations of aluminum, steel, plastics, plastic composites, fiber-glasses, ceramics, brass, titanium, carbon fiber, epoxies, or other suitable materials. The bracket 5 can be made using a number of metals, such as aluminum, brass, titanium, steel, as well as strong ceramics, plastics, plastic composites, and fiber-glasses. The pads 416, and 531 can be made out of a number of materials including but not limited to: cork (the most common in the art), felts, cloth, rubber, silicon, or other friction increasing materials; all of which protect the surfaces of the instrument 7.

Figure 4A:
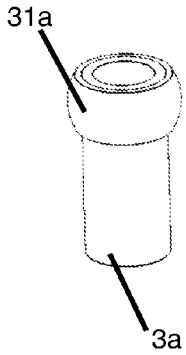
FIG. 4A—Isometric view of alternate embodiment of ball-post.
Figure 4B:
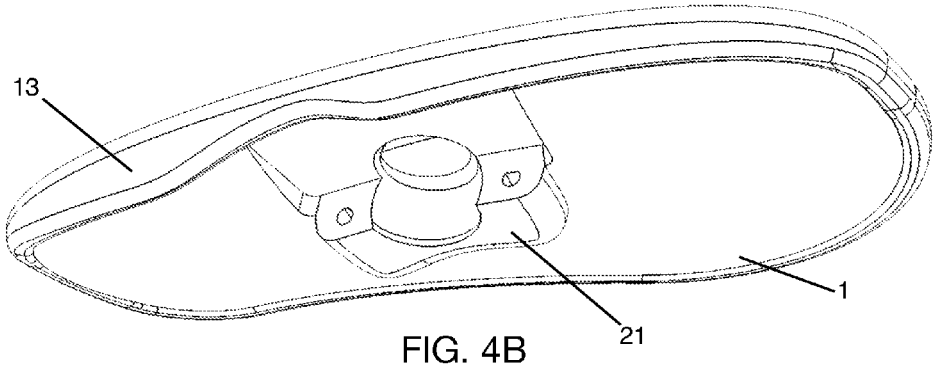
FIG. 4B—Isometric view of alternate embodiment of chin-plate and rear ball-clamp.
Figure 4C:
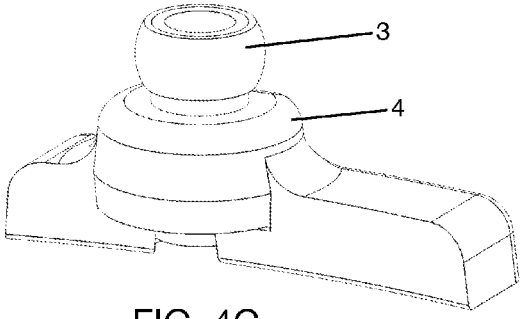
FIG. 4C—Isometric view of alternate embodiment of ball-post and base-clamp.
Figure 4D:
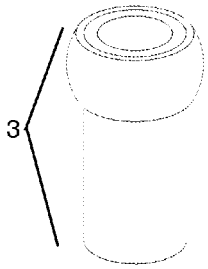
FIG. 4D—Isometric view of alternate embodiment of ball-post.
Figure 4E:
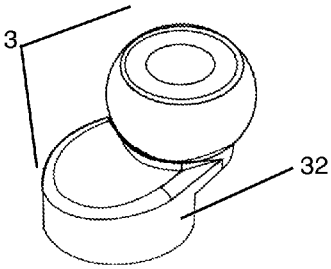
FIG. 4E—Isometric view of alternate embodiment of ball-post.
Figure 4F:
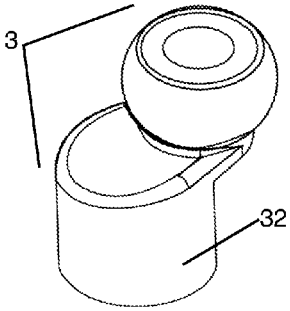
FIG. 4F—Isometric view of alternate embodiment of ball-post.
Figure 4G:
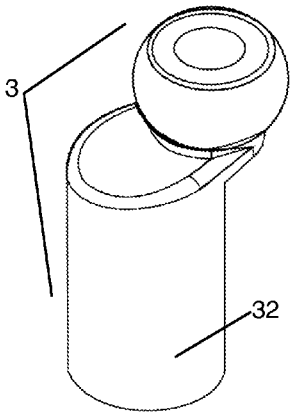
FIG. 4G—Isometric view of alternate embodiment of ball-post.

Alternate Embodiments—FIGS. 3A, 3B, 3C, 4A, 4B, 4C, 4D, 4E, 4F, 4G, 5C, 5D, and 5E There are various possibilities with regard to several aspects of form and operation of the chin support. One embodiment (FIG. 4B) can be made in which the chin-plate 1 and rear ball-clamp 21 are fashioned as one part. In this case, there would be no need to affix the rear ball-clamp 21 to the chin-plate 1, as both would be molded, machined, or otherwise fashioned into the same part. Another embodiment (FIGS. 4D, 4E, 4F, and 4G) can include a ball 31 and post 32 that are molded, machined, or otherwise fashioned into the same part. Another embodiment (FIG. 4C) can include a base-clamp 4 and ball-post 3 that are molded, machined, or otherwise fashioned into the same part. This would remove the need for a clamp 411 and associated screw 414 and screw socket 412. Another embodiment can include a base-clamp 4 and bracket 5 that are molded, machined, or otherwise fashioned into the same part. Another embodiment can include a chin-plate 1, ball-clamp 2, and ball-post 3, which are molded, machined, or otherwise fashioned into the same part. Another embodiment can include a ball-post 3, base-clamp 4, and bracket 5, that are molded, machined, or otherwise fashioned into the same part. Another embodiment (FIG. 4B) can have alternate shapes and forms of the chin-plate 1 other than those pictured, as is commonly known in the art, including a chin-plate extension 13. Said shapes can be included to modify the contours of the chin-plate 1 to increase the comfort and/or security of the chin-plate 1 as per each player's needs. Alternate embodiments of the shape of the chin-plate 1 can including molding, machining, or otherwise fashioning the chin-plate 1 to the exact shape of a player's jaw by taking a mold of their jaw or otherwise determining the shape of their jaw. Another embodiment can include a chin-plate 1 with a top-side surface that has been treated with a friction increasing, anti-allergenic, pliable, or moldable material in order to increase comfort and/or security from slipping. Said material can be molded to accommodate the shape of each individual player's jaw.

Other embodiments (FIG. 4D) can include a ball-post 3 that is straight. Another embodiment (FIGS. 4E, 4F, and 4G) of the ball-post 3 can include an alternate post 32 that is fashioned into one or more lengths. Said alternate post 32 lengths can provide the player with another or alternate means to adjust the height of the chin support.

Another embodiment (FIGS. 3A and 3B) can include a modified ball-clamp (12*a*+11*a*) including a ball-socket 11*a*, and a clamping ring 12*a*. The ball-socket 11*a* can be made separately and thereafter affixed to the underside of the chin-plate 1*a*, or the ball-socket 11*a* can alternately be molded, machined, or otherwise fashioned into the same part as the chin-plate 1*a*. The ball-socket 11*a* (FIG. 3C) includes an outer surface with male threads 111*a*, and an inner ball-socket 112*a* that approximates the curvature of the ball 31. The clamping ring 12*a* includes an inner female-threaded surface 121*a*, and an inner ball-socket 112*a* that approximates the curvature of the ball 31. This clamp 12*a*+11*a* is operated by placing the ball 31 into the upper ball-socket 112*a*, then sliding the clamping ring 12*a* upwards so that the inner female-threaded surface 121*a* mates with the outer surface male threads 111*a* of the ball-socket 11*a*, thereby effectively clamping the ball 31 between the ball-socket 11*a* and the clamping ring 12*a*. The clamping ring 12*a* can then be tightened or loosened in order to prevent movement or allow movement respectively of the ball 31 and thus the ball-post 3. Another embodiment of the modified ball-clamp (12*a*+11*a*) can be fashioned so that the ball-socket 11*a* has an inner surface with female threads, and the clamping ring 12*a* has an outer surface with male threads.

Another embodiment (FIGS. 3A and 3B) can include a modified base-clamp 4*a* including a collet-base 42*a*, and a collet-ring 41*a*. The collet-base 42*a* includes a male-threaded outer surface 422*a*, and a smooth or textured inner hollow 421*a*. The collet-ring 41*a* includes a female-threaded inner surface 411*a*. In order to operate the base-clamp 4*a*, the collet-ring's 41*a* inner female-threaded surface 411*a* are mated with the collet-base's 42*a* male-threaded outer surface 422*a*. Then the ball-post 3 is inserted into the inner hollow 421*a* of the collet-base 42*a*. The collet-ring 41*a* is then tightened down or loosened to prevent or allow movement respectively of the ball-post 3, and thus the chin-plate 1*a*. The collet base includes a pad 416 (FIG. 5B) that is affixed to the underside surface of the collet-base 42*a* to protect the instrument 7. The collet-base 4*a* is affixed to the instrument 7 using the bracket 5 (FIGS. 5A and 5B) as is commonly known in the art. Another embodiment (FIG. 5D) of the base clamp 4 and bracket 5 can include a base clamp 4 that extends over the tailpiece 4 of the instrument 7. For this embodiment, the bracket 5 can mate with the base clamp 4 on both sides of the tailpiece 73, as is commonly known in the art.

The bracket 5 (FIGS. 5A and 5B) can be fashioned into many different forms as is commonly known in the art. Therefore other embodiments of the base-clamp 4 (FIG. 1A) and collet-base 4*a* (FIG. 3A) can be fashioned to include modified screw sockets 413 or other alternate ways of affixing the bracket 5 to the base-clamp 4 or collet-base 4*a*. One embodiment (FIG. 5C) of the base clamp 4 and bracket 5 can be fashioned so that only one angled bracket screw 51, one threaded tensioning sleeve 52, and a single angle bracket 53 is used to affix the entire chin support to the instrument 7. Other embodiments of the base-clamp 4 or collet-base 4*a* can be fashioned where the bracket 5 or parts thereof are molded, machined, or otherwise fashioned into the same part as the base-clamp 4 or collet-base 4*a*. Another embodiment can include alternate embodiments of the bracket 5 and other methods of affixing a chin support to an instrument 7 that are commonly known in the art. Another embodiment (FIG. 5E) can include the addition of a friction increasing, anti-allergenic, pliable, moldable material, or a pad 8 on the outer surface of the threaded angle bracket 53 in order to increase comfort and/or security from slipping. This material or pad 8 could be affixed to the threaded angle bracket 53 via glue or other affixing method, as well as being attached by clamping the material or pad between the threaded angle bracket 53 and the instrument 7.

Other embodiments can include any and all above embodiments in any and all possible combinations using any and all possible combinations of materials.

Advantages

From the description above, a number of advantages of embodiments of my chin support become evident:

a) The player will be able to customize all 3-dimensional angles of the chin support according to their needs so as to increase comfort, security, and alleviate all-to-common injuries resulting from one-size-fits-all chin supports currently available in the common art.

b) The player will be able to customize the height and lateral position of the chin support according to their needs so as to help them find the proper postural set-up and to find the proper placement of the instrument to increase ease of playing.

c) Due to the nature of the chin support, the player will also be able to continually experiment with the position of the chin support; a benefit no other chin support in the common art can claim. This means that the chin support can effectively "grow" with a younger player, or allow any player to develop and change the way they hold the instrument according to their changing needs.

d) The chin support allows for all of the above capabilities in a practical and easy way, requiring no previous expertise to operate.

Conclusions, Ramifications, Scope

Accordingly, the reader will see that the adjusting devices of the various embodiments can be used to help players find their own individual set-up easily, securely, and comfortably. In addition, the chin support allows players to continually change and customize the position of the chin support and thus the instrument, thereby facilitating the exploration by the player about their own playing needs.

Although the description above contains many specificities, these should not be construed as limiting the scope of the embodiments but as merely providing illustrations of some of the presently preferred embodiments. For example, the chin-plate 1 can have other shapes, such as those designed to accommodate players with more rounded chin shapes or more angular chin shapes, etc.; the clamping mechanisms can be machined from or molded into other adjacent parts, etc.; certain capabilities can be left out, such as removing the base-clamp 4 thereby removing the capability to adjust the height or lateral placement of the chin support, or removing the ball-clamp 2 thereby removing the ability to adjust the associated angles; and other materials and manufacturing methods may be used to fashion the various parts of other embodiments.

Thus the scope of the embodiments should be determined by the claims and their legal equivalents, rather than by the examples given.

What is claimed is:

1. A chin support for violin and similar string instruments comprising a chin-plate, a ball-post, a base-clamp, and a bracket-assembly being secured to a violin;

said chin-plate coupled to an approximately spherical section of said ball-post, and said base-clamp coupled to an approximately cylindrical section of said ball-post, and said base-clamp coupled to said bracket-assembly, and said bracket-assembly affixed to said violin, wherein the ball-post comprises one or more of ball-posts, at least one of the one or more ball-posts, comprises a ball offset wherein the ball offset comprises a distance from an axis of a cylindrical section of the at least one of the one or more ball-posts, whereby a human can, hold and play said violin or similar string instrument, and customize, via the one or more ball-posts, at least one of, an angle of rotation, yaw, pitch, and tilt of the chin-plate, and a lateral placement of the chin-plate, and prevent a movement of at least one of an angle of rotation, yaw, pitch, and tilt of the chin-plate, and a lateral placement of the chin-plate.

2. The chin-plate means of claim 1 wherein said means further comprises a ball-socket, and a ball-clamp providing a means of controllably coupling with said spherical section of said ball-post into said ball-socket.

3. The ball-clamp of claim 2 wherein said ball-clamp comprises a front ball-clamp, and a rear ball-clamp connected by a means of operation whereby a human can choose to tighten or loosen said ball-clamp.

4. The base-clamp means of claim 1 wherein said means further comprises an inner hollow, and a means for operating said means for controllably coupling said inner hollow with said cylindrical section of said ball-post.

5. A chin support for violin and similar string instruments comprising a chin-plate, a ball-post, a base-clamp, a bracket-assembly, and a pad being secured to a violin;

said chin-plate coupled to an approximately spherical section of said ball-post, and said base-clamp coupled to an approximately cylindrical section of said ball-post, and said base-clamp coupled to said bracket-assembly, and said bracket-assembly affixed to said violin, and said pad affixed to or coupled with said bracket assembly, wherein the ball-post comprises one or more of ball-posts, at least one of the one or more ball-posts, comprises a ball offset wherein the ball offset comprises a distance from an axis of a cylindrical section of the at least one of the one or more ball-posts, whereby a human can, hold and play said violin or similar string instrument, and customize, via the one or more ball-posts, at least one of, an angle of rotation, yaw, pitch, and tilt of the chin-plate, and a lateral placement of the chin-plate, and prevent a movement of at least one of an angle of rotation, yaw, pitch, and tilt of the chin-plate, and a lateral placement of the chin-plate.

6. The pad of claim 5 wherein said pad further comprises a friction increasing surface thereby increasing the security of said violin on said human's body.

7. The pad of claim 5 wherein said pad further comprises a soft material thereby increasing the comfort of said human when said human plays said violin.

8. A method of adjusting a chin support for a violin or similar string instrument, comprising:

providing a ball post comprising a ball offset, wherein the ball offset comprises a distance from an axis of an approximately cylindrical section of the ball-post;

providing a chin-plate adapted to couple with an approximately spherical section of the ball-post, and a base-clamp adapted to couple with the approximately cylindrical section of said ball-post, and said base-clamp adapted to couple with a bracket-assembly, and said bracket-assembly adapted to couple to said violin;

operating said chin-support so that a human can adjust a vertical orientation of said chin-plate relative to said violin and said human's body;

operating said chin-support so that said human can limit the movement of said chin-plate;

operating said base-clamp so that a human can adjust the orientation of said ball-post relative to said violin and said human's body;

operating said base-clamp so that said human can limit the movement of said ball-post;

operating said bracket-assembly so that said human can affix said chin support to said violin or similar string instrument.

* * * * *